United States Patent [19]

Masuda et al.

[11] Patent Number: 4,465,331

[45] Date of Patent: Aug. 14, 1984

[54] DEVICE FOR PREVENTING RADIO FREQUENCY INTERFERENCE FROM SPARK PLUG

[75] Inventors: Isao Masuda, Tachikawa; Tadashige Kondo, Tokyo, both of Japan

[73] Assignee: Kioritz Corporation, Tokyo, Japan

[21] Appl. No.: 568,950

[22] Filed: Jan. 6, 1984

Related U.S. Application Data

[63] Continuation of Ser. No. 310,707, Oct. 13, 1981, abandoned.

[30] Foreign Application Priority Data

Oct. 2, 1980 [JP] Japan ..... 55-139735

[51] Int. Cl.[3] ..... H01R 4/66

[52] U.S. Cl. ..... 339/14 R; 339/DIG. 3; 339/143 S; 339/26

[58] Field of Search ..... 339/DIG. 3, 26, 27, 339/14, 143 S, 89 C, 147

[56] References Cited

U.S. PATENT DOCUMENTS 1,940,325 12/1933 Rabezzana ..... 339/26
2,323,399 7/1943 Jacobi ..... 339/26
2,621,312 12/1952 Mascuch et al. ..... 339/89 C
2,730,562 1/1956 Marden ..... 174/35
3,965,879 6/1976 Fitzner ..... 123/148 P

FOREIGN PATENT DOCUMENTS 137259 3/1979 Japan .

*Primary Examiner*—Eugene F. Desmond
*Assistant Examiner*—David L. Pirlot
*Attorney, Agent, or Firm*—Karl W. Flocks; Sheridan Neimark; A. Fred Starobin

[57] ABSTRACT

A device for preventing radio frequency interference generated by spark plug of internal combustion engines. The device includes a cover member adapted to cover at least a part of the high-voltage portion of the spark plug such as high-tension cord together with the end of the plug connected to the cord. The cover member is made of a highly soft, flexible and electrically conductive rubber material (high molecular compound). The cover member is grounded through a grounding line to the body of the engine. This device is suitable for use in machines having limited space for mounting the radio frequency interference prevention device, such as chain saw having an internal combustion engine.

1 Claim, 2 Drawing Figures

DEVICE FOR PREVENTING RADIO FREQUENCY INTERFERENCE FROM SPARK PLUG

This application is a continuation of application Ser. No. 310,707, filed Oct. 13, 1981. now abandoned.

BACKGROUND OF THE INVENTION

The present invention relates to a device for preventing radio frequency interference from a spark plug of spark ignition type internal combustion engine.

Various devices have been proposed and used for preventing radio frequency interference from spark plug of internal combustion engines. In the case of engines of automobiles, motorcycles and the like, there are comparatively large spaces for accomodating such devices, so that the shape and size of the device have large freedom of choice. In the case of engines mounted on portable working machines such as chain saws, the shape and size of the device for preventing the radio frequency interference are impractically limited due to restriction in the space and weight. In addition, there are various problems such as contact with human body, wetting by water or moisture, and so on.

SUMMARY OF THE INVENTION

Accordingly, an object of the invention is to provide a device for preventing radio frequency interference from spark plugs of spark ignition type internal combustion engines, capable of eliminating the above-described problems of the prior art.

To this end, according to the invention, there is provided a device for preventing radio frequency interference from a spark plug of internal combustion engines in which a cover member made from an electrically conductive high molecular compound such as of rubbery material is used in place of the conventional cover member which is usually made of a metal gauze or the like material having a high electric conductivity. This cover member, due to its flexibility and elasticity, is quite easy to attach and is never broken nor does it injure the human body when it happens to come into contact with the human body. This cover member is effective also in protecting the protecting cap of the spark plug to prevent secular change or deterioration of the latter. The flexibility and elasticity also serve to closely fit the cover member to the shape of the object or the shape of the space therearound, while preventing water or moisture from coming to the inside thereof. Thus, the present invention provides a highly practical and safe device for preventing radio frequency interference from spark plugs of internal combustion engines.

The above and other objects, as well as advantageous features of the invention will become clear from the following description of the preferred embodiments taken in conjunction with the accompanying drawings.

BRIEF DESCRIPTION OF THE DRAWINGS:

The accompanying drawings show an embodiment in which.

DESCRIPTION OF THE PREFERRED EMBODIMENT

Figure 1:
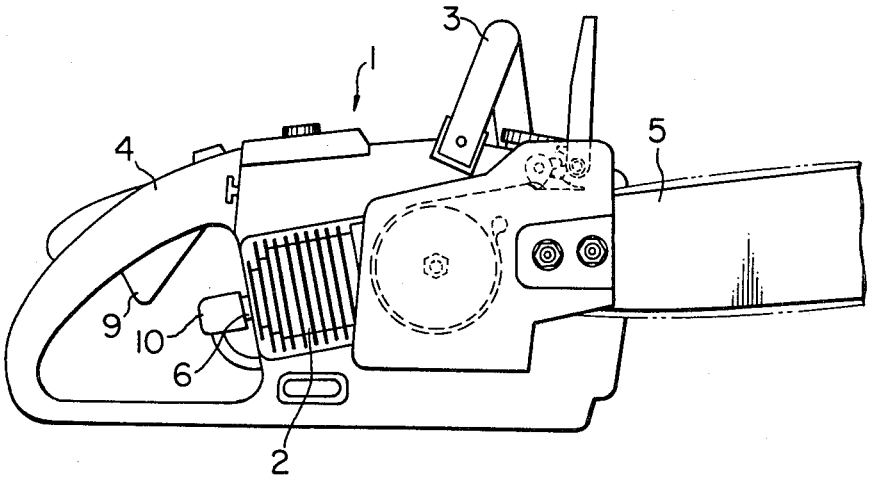
FIG. 1 is a side elevational view of a chain saw.

A preferred embodiment of the invention will be described hereinunder with reference to the accompanying drawings. This embodiment is applied to a spark ignition type internal combustion engine mounted on a chain saw. The engine has a substantially horizontally arranged cylinder with a spark plug projected rearwardly toward a rear handle of the chain saw. In this type of chain saw, there is a large possibility of injury by contacting the finger of the right hand of the operator with the spark plug, though the latter is electrically insulated, because the operator grips the rear handle with his right hand and manipulates a throttle lever of the engine with a suitable finger of his right hand. Similar problems are experienced also in the chain saws having a vertical cylinder. In this case, the accidential contact tends to occur between the left hand finger and the spark plug positioned in the vicinity of the front handle.

It is highly desirable that the danger of contact of fingers with the spark plug, as well as leak of radio-frequency electric wave due to deterioration of the plug cap or high-tension cord, is completely eliminated.

The chain saw 1 has the engine, front handle 3, rear handle 4 and a saw unit 5. The engine has a cylinder 2 disposed substantially horizontally to direct the cylinder head rearwardly, so that the spark plug 6 is projected into the space defined by the rear handle 4. The spark plug 6 is electrically coupled to a high tension cord (high voltage line) 8 extended through a cap 7.

A throttle trigger 9 for controlling the engine and other controlling parts is arranged in the vicinity of the rear handle 4 which is adapted to be held by the right hand of the operator. In consequence, the fingers of the right hand of the operator are positioned dangerously in the close proximity of the spark plug 6. In order to diminish as much as possible the amount of projection of the spark plug 6 into the space, it is possible to mount the spark plug 6 at an inclination to the axis of the cylinder. This countermeasure, however, cannot eliminate the leak of high-voltage current not only through the fingers contacting the spark plug 6 but also directly to the body of the chain saw and, hence, to the ground. This phenomenon is quite dangerous and should be avoided by all means.

In the illustrated embodiment of the invention, a cover member 10 is formed to have a size and shape suitable for covering at least a part of the cap 7 of the spark plug 6 annd at least a part of the high-tension cord 8 to cover and insulate the high-voltage circuit for the spark plug 6 as much as possible. The cover member 10 is made from a highly soft, flexible and electrically conductive rubber material (high molecular compound).

Figure 2:
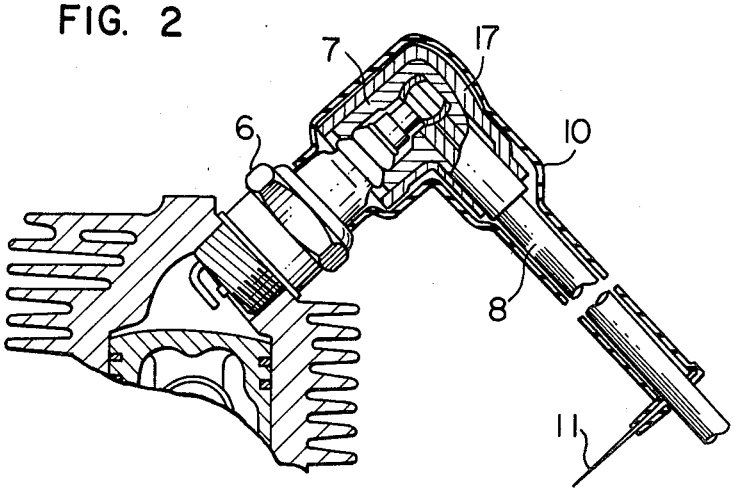
FIG. 2 is a sectional view of an essential part of a device for preventing radio frequency interference in accordance with an embodiment.

Namely, as will be seen from FIG. 2, the spark plug 6 has a cap 7 which in turn is protected by a cap protecting cover 17 fitting thereon. The high-tension cord 8 is extended through the cap 7. The most part of the thus exposed high-voltage circuit is covered by the cover member 10 made of the soft, flexible and electrically conductive rubber material (high molecular compound). The cover member 10 has a grounding portion grounded to the body of the chain saw 1 through a grounding line 11. Since the soft and flexible material of the cover member 10 makes a tight fit around the parts covered by the cover member 10, thereby to effectively prevent ambient water and moisture from coming inside the cover member 10.

What is claimed is:

1. A device for preventing radio frequency interference from a spark plug for a spark ignition type internal combustion engine comprising: a cover member made of a soft, flexible and electrically conductive rubbery high molecular compound, said cover member fitting tightly around at least a part of the high-voltage portion of said spark plug; and means for grounding said cover member to the body of said engine, said cover member extending only to those portions of the spark plug not including the high temperature base portion of the spark plug, a ground line grounded to the engine and connected to said cover member, said grounded line connected to said cover member at a spaced distance from the spark plug along a connecting high tension cord attached to said spark plug to prevent ambient water and moisture from entering said cover member.

* * * * *